US009267316B2

(12) United States Patent
Ding

(10) Patent No.: US 9,267,316 B2
(45) Date of Patent: Feb. 23, 2016

(54) DOOR CLOSER

(71) Applicant: Joy Chief Hardware Industrial Corp., Tainan (TW)

(72) Inventor: Kun-Lin Ding, Tainan (TW)

(73) Assignee: Joy Chief Hardware Industrial Corp., Tainan (TW)

( * ) Notice: Subject to any disclaimer, the term of this patent is extended or adjusted under 35 U.S.C. 154(b) by 0 days.

(21) Appl. No.: 14/287,555

(22) Filed: May 27, 2014

(65) Prior Publication Data

US 2015/0345201 A1 Dec. 3, 2015

(51) Int. Cl.
*E05F 1/12* (2006.01)

(52) U.S. Cl.
CPC ..... *E05F 1/1223* (2013.01); *Y10T 16/299* (2015.01)

(58) Field of Classification Search
CPC ..... Y10T 16/27; Y10T 16/299; Y10T 16/56; Y10T 16/585; E05F 1/1041; E05F 3/22; E05F 3/227; E05F 2003/228; E05F 1/1223; E05Y 2900/132
USPC ..... 16/49, 65, 71, 80
See application file for complete search history.

(56) References Cited

U.S. PATENT DOCUMENTS

| | | | | | |
|---|---|---|---|---|---|
| 2,958,089 | A * | 11/1960 | Roehm et al. | ..... | 16/49 |
| 5,088,152 | A * | 2/1992 | Downey | ..... | 16/80 |
| 5,309,676 | A * | 5/1994 | Appelmann et al. | ..... | 49/253 |
| 5,381,628 | A * | 1/1995 | D'Hooge | ..... | 49/394 |
| 5,829,508 | A * | 11/1998 | DeBower et al. | ..... | 160/371 |
| 7,865,999 | B2 * | 1/2011 | Hilger | ..... | 16/65 |
| 2007/0119019 | A1 * | 5/2007 | McKinney et al. | ..... | 16/79 |

* cited by examiner

*Primary Examiner* — William Miller
(74) *Attorney, Agent, or Firm* — C. G. Mersereau; Nikolai & Mersereau, P.A.

(57) ABSTRACT

A door closer has a fixing set, a bidirectional set and an extending set. The fixing set has an elongated tube. The elongated tube has two opposite sidewalls and an opening. The bidirectional set is connected to the fixing set, is movably mounted in the elongated tube and has a connecting panel formed on and protruding from the bidirectional set and extending out of the opening. The extending set is pivotally connected to the bidirectional set and has a guiding track, an extending arm, a locking board and a connecting panel. The extending arm is movably mounted in the guiding track and has a connecting end extending out of the guiding track. The locking board engages the guiding track and is connected to the extending arm to adjust a total length of the extending set. The connecting panel is connected to the connecting end of the extending arm.

14 Claims, 11 Drawing Sheets

DOOR CLOSER

BACKGROUND OF THE INVENTION

1. Field of the Invention

The present invention relates to a door closer, and more particularly relates to a door closer that is connected between a door frame and a door panel to assist the door panel to move backwardly the original position relative to the door frame and can be assembled between a door frame and a door panel of different sizes.

2. Description of Related Art

With reference to FIG. 11, a conventional door closer is connected between a door frame 60 and a door panel 61 and has an elongated tube 70, a connecting base 76 and a linking set 72. The elongated tube 70 is hollow, is connected to a top of the door panel 61 and has a top side, a track slot and a sliding block 71. The track slot is formed in the top side of the elongated tube 70. The sliding block 71 is slidably mounted in the track slot of the elongated tube 70 and had a top end extending out of the top side of the elongated tube 70. The connecting base 76 is securely mounted on a side of the door frame 60 and has a bottom side.

The linking set 72 is connected to the elongated tube 70 and the connecting base 76 and has an arm pipe 73 and a linking shaft 74. The arm pipe 73 is hollow, is connected to the sliding block 71 of the elongated tube 70 and has a connecting end and a mounting end. The connecting end of the arm pipe 73 is pivotally connected to the top end of the sliding block 71. The linking shaft 74 is mounted in the arm pipe 73, is pivotally connected to the connecting base 76 and has an inserting end and a pivot end. The inserting end of the linking shaft 74 is inserted into the arm pipe 73 via the mounting end of the arm pipe 73 and is securely connected to the arm pipe 73 by a fastener 75. The pivot end of the linking shaft 74 is pivotally connected to the bottom side of the connecting base 76. In addition, the position of the inserting end of the linking shaft 74 can be adjusted relative to the arm pipe 73 to change the total length of the linking set 72.

In use, after the conventional door closer is connected to the door frame 60 and the door panel 61, when the door panel 61 is open to rotate relative to the door frame 60, the linking set 72 is rotated relative to the connecting base 76 by the sliding block 71 moving in the track slot of the elongated tube 70. In addition, the linking set 72 can be used to limit the rotating angle of the door panel 61 relative to the door frame 60. Furthermore, when the door panel 61 is closed to move backwardly to the door frame 60, the sliding block 71 is moved in the track slot in an opposite direction, and this can enable the linking set 72 to assist the door panel 61 to move backwardly the original position.

The linking set 72 of the conventional door closer can be adjusted to change the total length of the conventional door closer, and this can enable the conventional door closer to assemble on the door frame 60 and the door panel 61 of different sizes. However, based on the cost and operation considerations of the conventional door closer, the adjusting range of the linking set 72 of the conventional door closer is limited and cannot be assembled on various sizes of door frame 60 and door panel 61. Therefore, different sizes of linking sets 72 are needed to be manufactured to use on various sizes of door frame 60 and door panel 61, and this will increase the cost of using the conventional door closer and will limit the practicality of the conventional door closer.

Therefore, the invention provides a door closer to mitigate or obviate the aforementioned problems.

SUMMARY OF THE INVENTION

The main objective of the present invention is to provide a door closer that is connected between a door frame and a door panel to assist the door panel to move backwardly the original position relative to the door frame and can be assembled between a door frame and a door panel of different sizes.

The door closer in accordance with the present invention has a fixing set, a bidirectional set and an extending set. The fixing set has an elongated tube. The elongated tube has two opposite sidewalls and an opening. The bidirectional set is connected to the fixing set, is movably mounted in the elongated tube and has a connecting panel formed on and protruding from the bidirectional set and extending out of the opening. The extending set is pivotally connected to the bidirectional set and has a guiding track, an extending arm, a locking board and a connecting panel. The extending arm is movably mounted in the guiding track and has a connecting end extending out of the guiding track. The locking board engages the guiding track and is connected to the extending arm to adjust a total length of the extending set. The connecting panel is connected to the connecting end of the extending arm.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
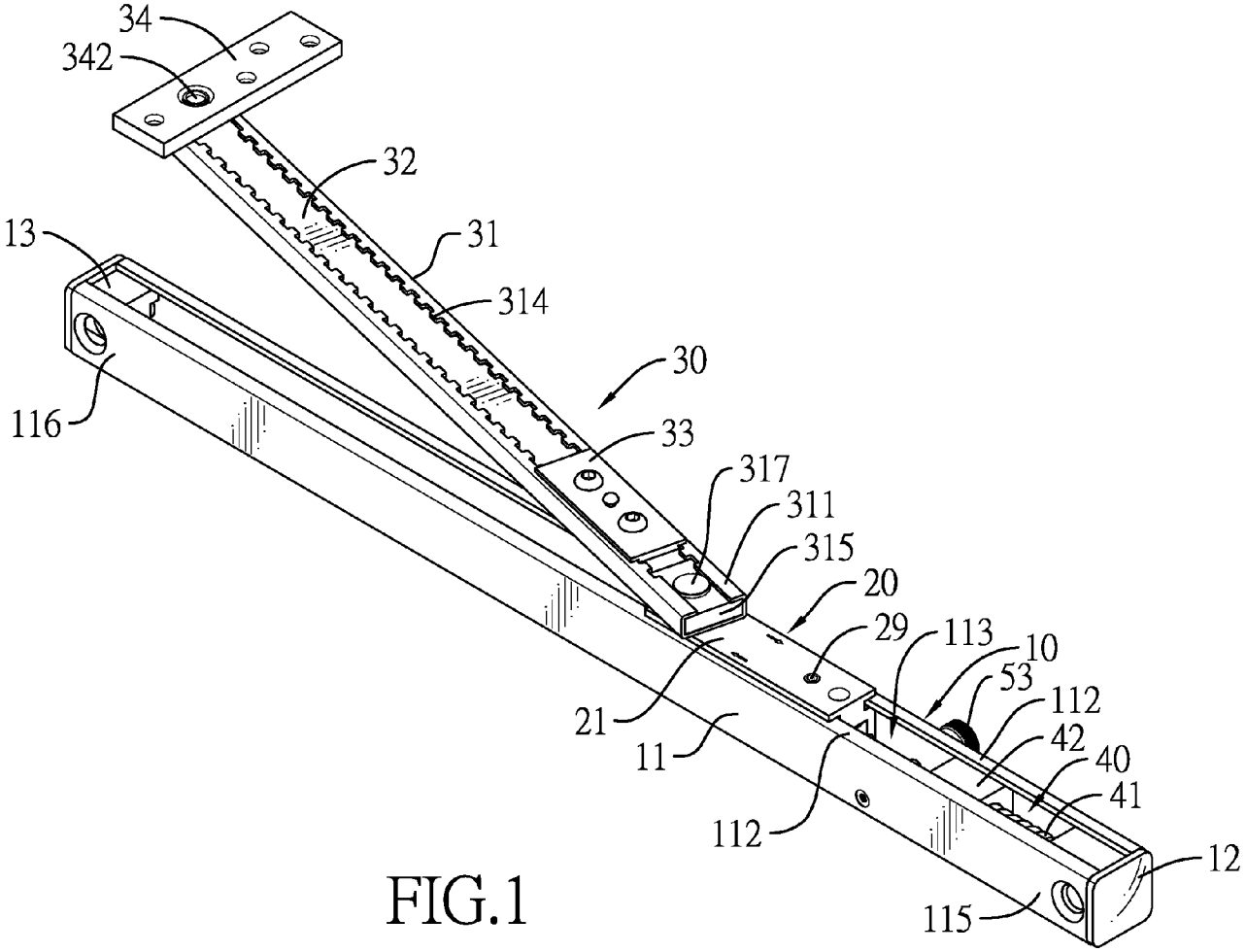
FIG. 1 is a perspective view of a door closer in accordance with the present invention.
Figure 2:
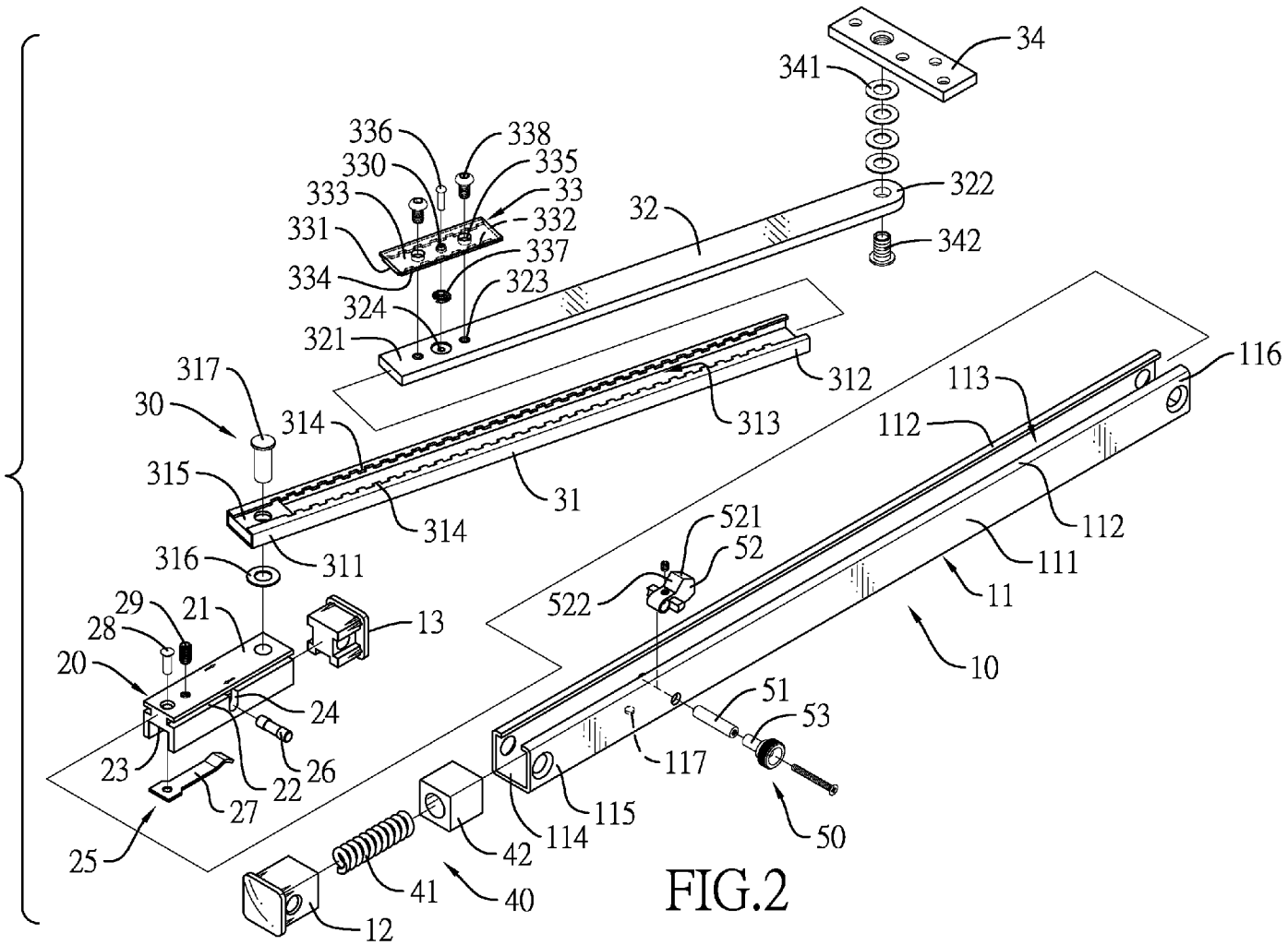
FIG. 2 is an exploded perspective view of the door closer in FIG. 1.

With reference to FIGS. 1 and 2, a door closer in accordance with the present invention comprises a fixing set 10, a bidirectional set 20, an extending set 30, an optional buffering set 40 and an optional switching set 50.

The fixing set 10 has an elongated tube 11, a first end plug 12 and a second end plug 13. The elongated tube 11 may be a hollow rectangular tube and has a top, a bottom, a first end 115, a second end 116, a bottom board 114, two opposite sidewalls 111, a track slot 112, an opening 113 and a limiting protrusion 117. The second end 116 of the elongated tube 11 is opposite to the first end 115 of the elongate tube 11. The bottom board 114 is formed on the bottom of the elongated tube 11 and has two opposite sides. The opposite sidewalls 111 are respectively formed on and protrude upwardly from the opposite sides of the bottom board 114, face to each other and each one of the opposite sidewalls 111 has an upper track edge.

The track slot 112 is formed in the elongated tube 11 between the bottom board 114 and the opposite sidewalls 111 of the elongated tube 11. The opening 113 is formed through the top of the elongated tube 11 between the upper track edges of the opposite sidewalls 111 and communicates with the track slot 112. The limiting protrusion 117 is formed on and protrudes from the bottom board 114 adjacent to the first end 115 of the elongated tube 11. The first end plug 12 is connected to the first end 115 of the elongated tube 11. The second end plug 13 is connected to the second end 116 of the elongated tube 11.

Figure 4:
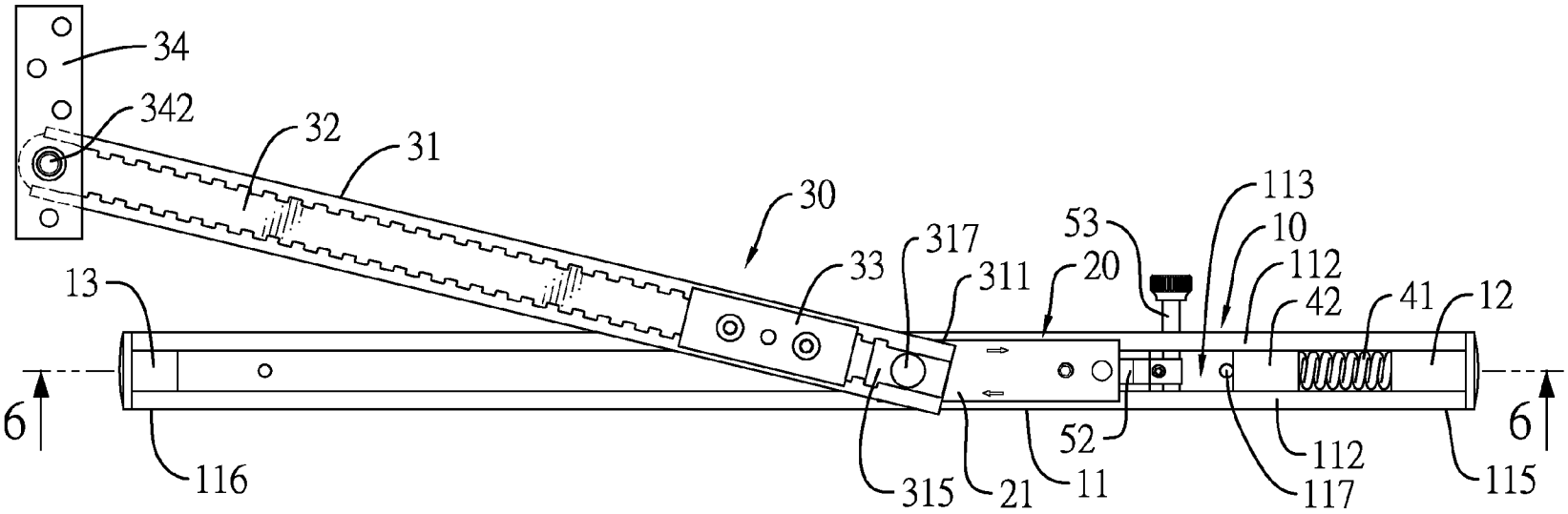
FIG. 4 is a top view of a door closer in FIG. 1.
Figure 6:
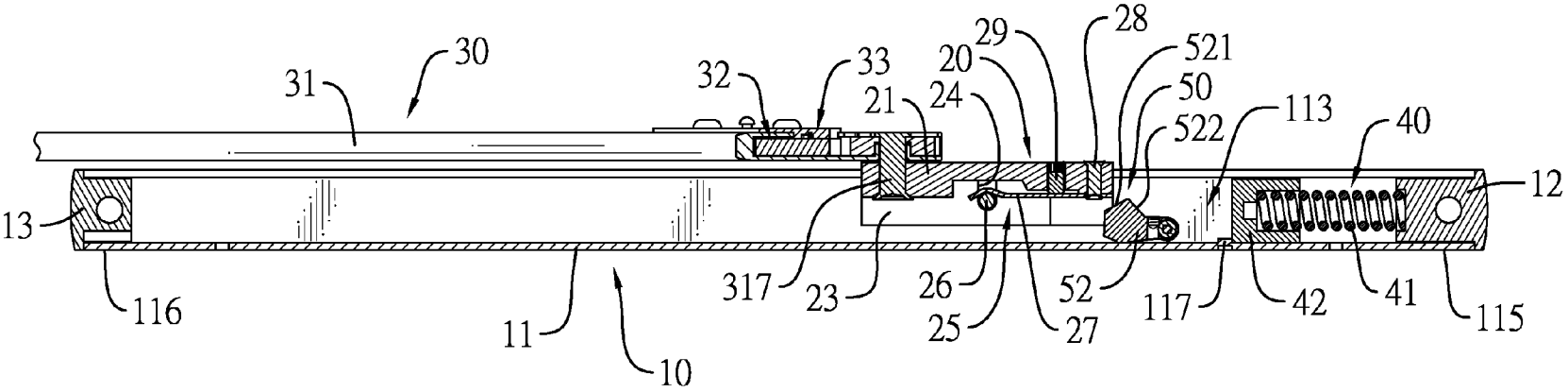
FIG. 6 is a side view in partial section of the door closer along line 6-6 in FIG. 4.

With reference to FIGS. 2, 4 and 6, the bidirectional set 20 may be a sliding block, is connected to the fixing set 10 and is movably mounted in the track slot 112 of the elongated tube 11. In addition, the bidirectional set 20 can be mounted in the track slot 112 via the first end 115 of the elongated tube 11 or the second end 116 of the elongated tube 11. The bidirectional set 20 has a body 23, a connecting board 21, two sliding recesses 22, a rod hole 24 and an engaging group 25. The body 23 may be a rectangular block, is movably mounted in the track slot 112 of the elongated tube 11 and has a top side, a bottom side, two sidewalls, two end sides and a concaved recess. The top side of the body 23 faces the upper track edges of the opposite sidewalls 111 of the elongated tube 11. The sidewalls of the body 23 respectively face the opposite sidewalls 111 of the elongated tube 11. The end sides of the body 23 respectively face the end plugs 12, 13 of the fixing set 10. The concaved recess is formed through the bottom side and the end sides of the body 23.

The connecting board 21 is formed on and protrudes from the top side of the body 23, extends out of the opening 113 of the elongated tube 11 and has a top side. The sliding recesses 22 are respectively formed in the sidewalls of the body 23 near the top side of the body 23 and below the connecting board 21. Then, the upper track edges of the opposite sidewalls 111 of the elongated tube 11 are respectively mounted in the sliding recesses 22, and this can enable the bidirectional set 20 to securely connect with the fixing set 10. The rod hole 24 is elongated, is formed through the sidewalls of the body 23 and communicates with the concaved recess of the body 23 and the sliding recesses 22.

The engaging group 25 is mounted in the concaved recess of the body 23, is connected to the rod hole 24 and has an engaging rod 26, an elastic slice 27 and a bolt 29. The engaging rod 26 may be a cylinder and is movably mounted in the rod hole 24 of the bidirectional set 20. The elastic slice 27 is mounted in the concaved recess of the body 23, is pressed against the engaging rod 26 and has a pressing end, a connecting end, a middle and a fixing element 28. The pressing end of the elastic slice 27 is pressed against the engaging rod 26. The connecting end of the elastic slice 27 is securely connected to the body 23 by the fixing element 28 mounting through the connecting board 21, mounting in the concaved recess of the body 23 and connecting with the connecting end of the elastic slice 27. Then, the elastic slice 27 can be securely held in the concaved recess of the body 23 between the engaging rod 26 and the fixing element 28. The bolt 29 is mounted through the connecting board 21, is mounted in the concaved recess of the body 23 and is pressed against the elastic slice 27 at the middle of the elastic slice 27. Then, the bolt 29 can be used to adjust the pressing force that the elastic slice 27 is pressed against the engaging rod 26.

With reference to FIGS. 1 and 2, the extending set 30 is pivotally connected to the bidirectional set 20 and has a guiding track 31, an extending arm 32, a locking board 33 and a connecting panel 34.

The guiding track 31 is an elongated-rectangular track, is pivotally connected to the bidirectional set 20 and has a bottom side, a top side, a pivot end 311, an inserting end 312, a track opening 313 and multiple positioning teeth 314, a sealing block 315, a first washer 316, a pivot pin 317. The bottom side of the guiding track 31 abuts the top side of the connecting board 21 to enable the pivot end 311 of the guiding track 31 to mount over the over the connecting board 21 and the elongated tube 11. The inserting end 312 of the guiding track 31 is formed on the guiding track 31 opposite to the pivot end 311 of the guiding track 31. The track opening 313 is formed through the top side of the guiding track 31 to form two end edges at the top side of the guiding track 31. The positioning teeth 314 are formed on and protrude inwardly from one of the end edges of the guiding track 31 at intervals or are formed on and protrude inwardly from the end edges of the guiding track 31 at intervals.

The sealing block 315 is mounted in the guiding track 31 at the pivot end 311 of the guiding track 31. The first washer 316 is mounted between the top side of the connecting board 21 and the bottom side of the guiding track 31. The pivot pin 317 is mounted through the sealing block 315, the bottom side of the guiding track 31, the first washer 316 and the connecting board 21 and is pivotally connected to the body 23 of the bidirectional set 20. Then, the guiding track 31 can be rotated relative to the bidirectional set 20 by the pivot end 311.

The extending arm 32 is elongated, is movably mounted in the guiding track 31 and has a top side, a bottom side, a positioning end 321, a connecting end 322, two threaded holes 323 and a through hole 324. The positioning end 321 of the extending arm 32 is mounted in the guiding track 31 via the inserting end 312 of the guiding track 31 adjacent to the sealing block 315. The connecting end 322 of the extending arm 32 is formed on extending arm 32 opposite to the positioning end 311 of the extending arm 32 and the extends out of the guiding track 31 via the inserting end 312 of the guiding track 31. The threaded holes 323 are formed through the top side and the bottom side of the extending arm 32 at an interval near the positioning end 321 of the extending arm 32. The through hole 324 is formed through the top side and the bottom side of the extending arm 32 between the threaded holes 323.

Figure 3:
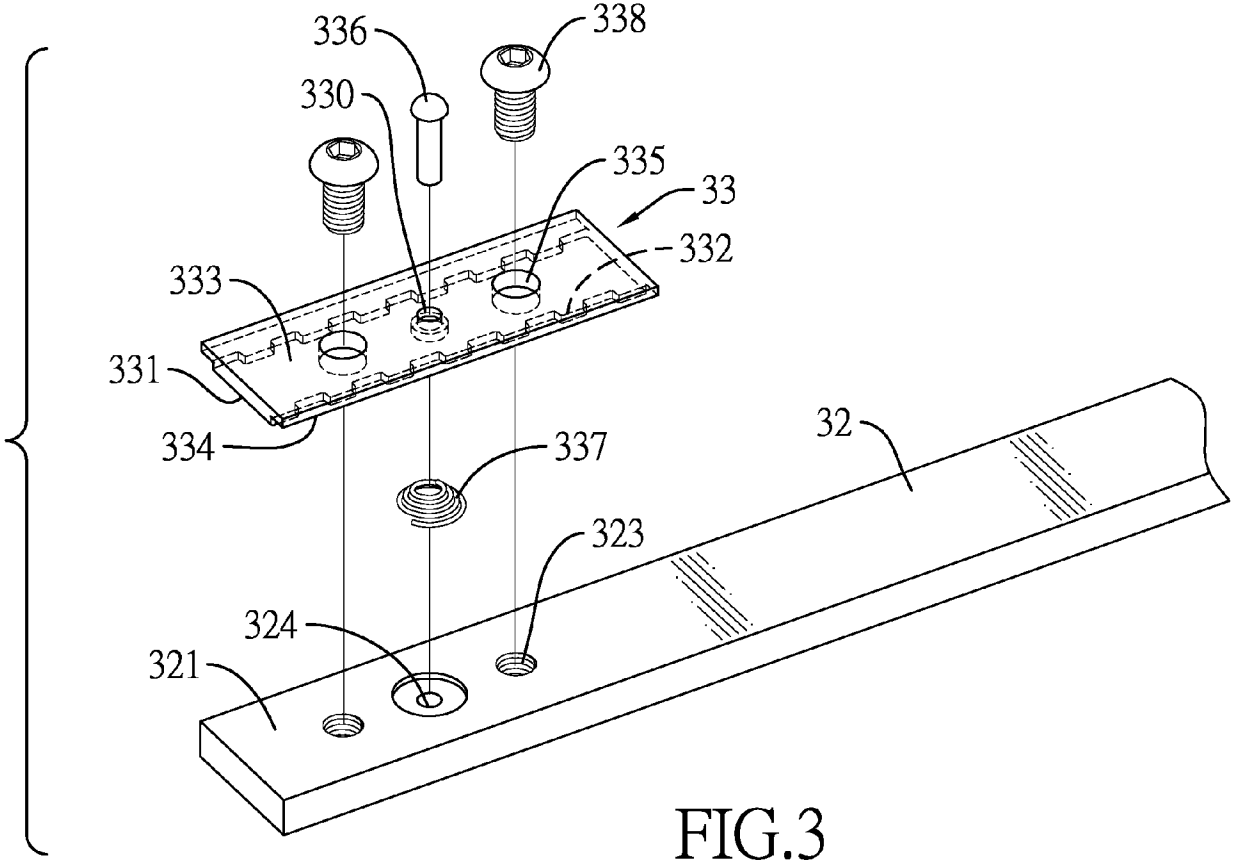
FIG. 3 is an enlarged and exploded perspective view of the door closer in FIG. 2.
Figure 5:
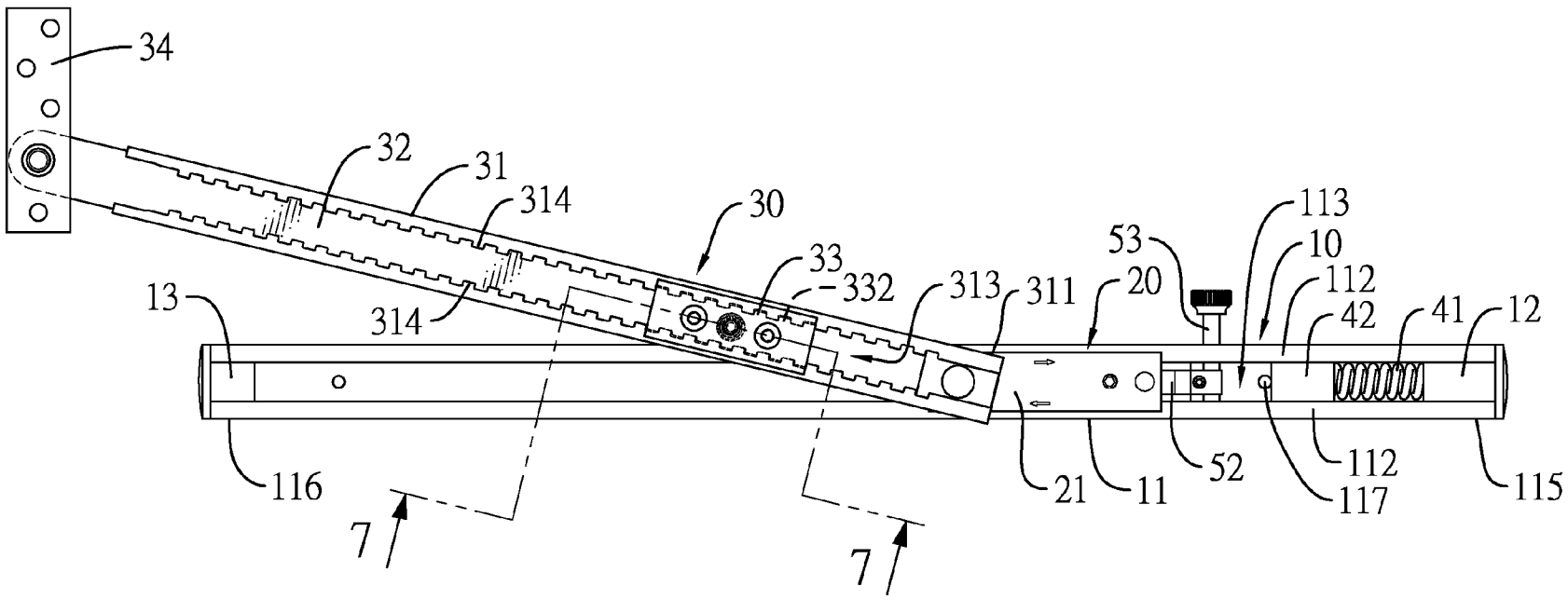
FIG. 5 is an operational top view of a door closer in FIG. 1.
Figure 7:
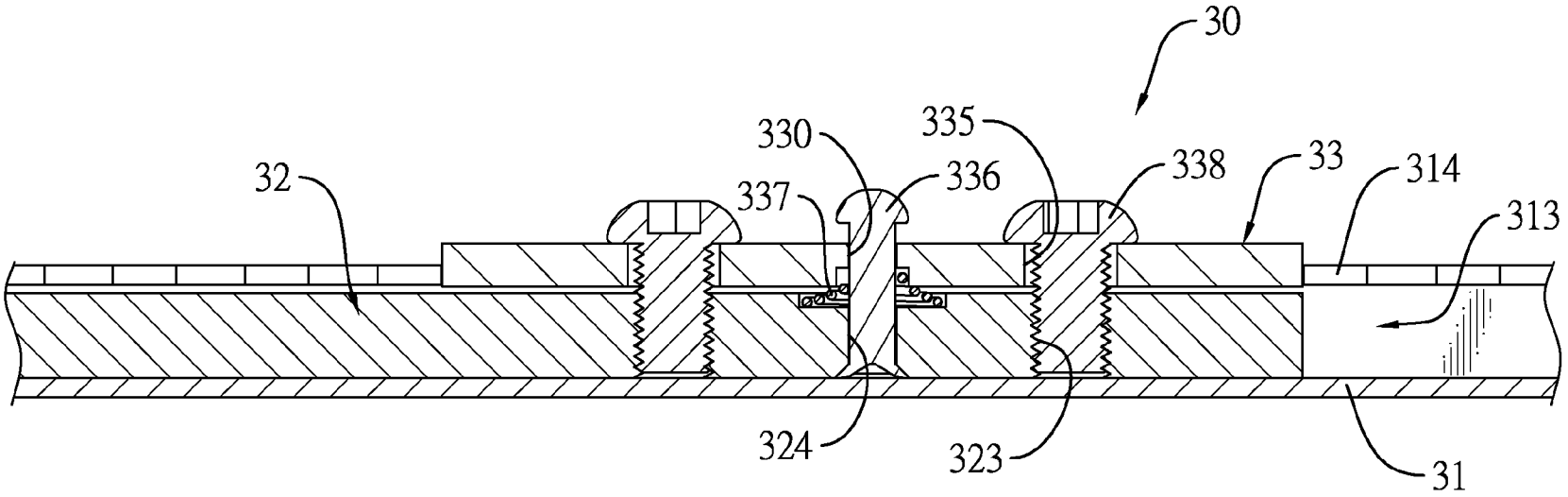
FIG. 7 is an enlarged side view in partial section of the door closer along line 7-7 in FIG. 5.

With reference to FIGS. 3, 5 and 7, the locking board 33 is connected to the extending arm 32, engages the guiding track 31 and has an engaging segment 331, a covering segment 333, two mounting holes 335, two screws 338, a rivet hole 330, a rivet 336 and a compression spring 337.

The engaging segment 331 may be rectangular, abuts the extending arm 32 and selectively engages the guiding track 31. The engaging segment 331 has a top side, a bottom side, two sidewalls and multiple engaging teeth 332. The bottom side of the engaging segment 331 abuts the top side of the extending arm 32. The engaging teeth 331 are formed on and protrude from one of the sidewalls of the engaging segment 331 at intervals or are formed on and protrude from the sidewalls of the engaging segment 331 at intervals. In addition, the engaging teeth 332 of the engaging segment 331 selectively engage the positioning teeth 314 of the guiding track 31.

The covering segment 333 is formed on the top side of the engaging segment 331, is mounted over the positioning teeth 314 of the guiding track 31 to cover the track opening 313 and has a top side, two opposite sides and two pressing edges 334. The pressing edges 334 are respectively formed on and protrude outwardly from the opposite sides of the covering segment 333 and extend out of the engaging teeth 332 of the engaging segment 331 to press the positioning teeth 314 of the guiding track 31. Then, the positioning teeth 314 of the guiding track 31 are mounted between the top side of the extending arm 32 and the pressing edges 334 of the locking board 33.

The mounting holes 335 are formed through the covering segment 333 and the engaging segment 331 at an interval and are respectively align with the threaded holes 323 of the extending arm 32. The screws 338 are respectively mounted through the mounting holes 335 and are respectively and securely connected to the threaded holes 323 of the extending arm 32 to connect the locking board 33 securely with the extending arm 32. Then, the extending arm 32 is securely held in the guiding track 31 by the locking set 33.

The rivet hole 330 is formed through the covering segment 333 and the engaging segment 331 between the mounting holes 335 and aligns the through hole 324 of the extending arm 32. The rivet 336 is mounted through the rivet hole 330 of the locking board 33 and the through hole 324 of the extending arm 32 and is connected to the bottom side of the extending arm 32. The compression spring 337 is mounted around the rivet 336 between the top side of the extending arm 32 and the engaging segment 331 of the locking board 33 to form a gap between the extending arm 32 and the locking board 33.

Furthermore, with reference to FIGS. 3 and 7, when the screws 338 are loosen, the compression spring 337 will push the locking board 33 to move upwardly relative to the guiding track 31 to enable the engaging teeth 332 to separate from the positioning teeth 314. Then, the extending arm 32 and the locking board 33 can be moved relative to the guiding track 31 and this can adjust the total length of the extending set 30. In addition, in the present invention, the extending arm 32 is securely connected to the guiding track 31 by the engagement between the positioning teeth 314 and the engaging teeth 332. Preferably, the extending arm 32 also can be adjustable connected to the guiding track 31 by fastening, fixing or pressing and so on to adjust the total length of the extending set 30. Additionally, when the screws 338 are loosen between the extending arm 32 and the locking board 33 to enable the engaging teeth 332 to separate from the positioning teeth 314, the rivet 336 can be used to provide a limiting effect to the locking board 33 to prevent the locking board 33 fully separating from the extending arm 32.

The connecting panel 34 is connected to the connecting end 322 of the extending arm 32 and has a top side, a bottom side, a pivot rod 342, at least one second washer 341 and multiple connecting holes. The pivot rod 342 is mounted through the connecting end 322 of the extending arm 32 from the bottom side to the top side of the extending arm 32 and is connected to the connecting panel 34. The at least one second washer 341 is mounted around the pivot rod 342 between the connecting panel 34 and the top side of the extending arm 32. The connecting holes are formed through the connecting panel 34 at intervals. Then, the connecting panel 34 can be mounted on a door frame by multiple fasteners mounting through the connecting holes of the connecting panel 34 and connecting to the door frame.

With reference to FIGS. 2, 4 and 6, the buffering set 40 is mounted in the fixing set 10 and has a buffering block 42 and a buffering spring 41. The buffering block 42 is movably mounted in the track slot 112 of the elongated tube 11 at the first end 115 of the elongated tube 11 adjacent the first end plug 12 and selectively abuts the limiting protrusion 117 of the elongated tube 11. The buffering spring 41 is mounted in the track slot 112 of the elongated tube 11 between the first end plug 12 and the buffering block 42 to push the buffering block 42 to abut against the limiting protrusion 117 of the elongated tube 11. Furthermore, the buffering spring 41 can provide a buffering force to the bidirectional set 20 via the buffering block 42.

With reference to FIGS. 2 4 and 6, the switching set 50 is connected to the fixing set 10, selectively engages the bidirectional set 20 and has a pivot pillar 51, a switching mount 52 and a rotating button 53. The pivot pillar 51 is rotatably connected to the opposite sidewalls 111 of the elongated tube 11 adjacent to the first end 115 of the elongated tube 11. The switching mount 52 is securely mounted around the pivot pillar 51, is rotatably mounted in the track slot 112 of the elongated tube 11 and selectively engages the engaging rod 26 of the engaging group 25 of the bidirectional set 20.

The switching mount 52 has a mounting end, an engaging end, a top, a guiding face 521 and a holding face 522. The mounting end of the switching mount 52 is securely mounted around the pivot pillar 51. The engaging end of the switching mount 52 is opposite to the mounting end of the switching mount 52. The guiding face 521 is obliquely formed on the top of the switching mount 52 at the engaging end of the switching mount 52 and selectively abuts the engaging rod 26 of the bidirectional set 20. The holding face 522 is obliquely formed on the top of the switching mount 52 between the mounting end and the guiding face 521 of the switching mount 52, is selectively pressed against the engaging rod 26 of the bidirectional set 20 and has an angle relative to the guiding face 521. The rotating button 53 is securely connected to a free end of the pivot pillar 51 at one of the opposite sidewalls 111 of the elongated tube 11 to rotate the switching mount 52 relative to the elongated tube 11. Then, the guiding face 521 and the holding face 522 of the switching mount 52, the buffering set 40 and the engaging group 25 can be used to provide a positioning effect to the bidirectional set 20.

Figure 8:
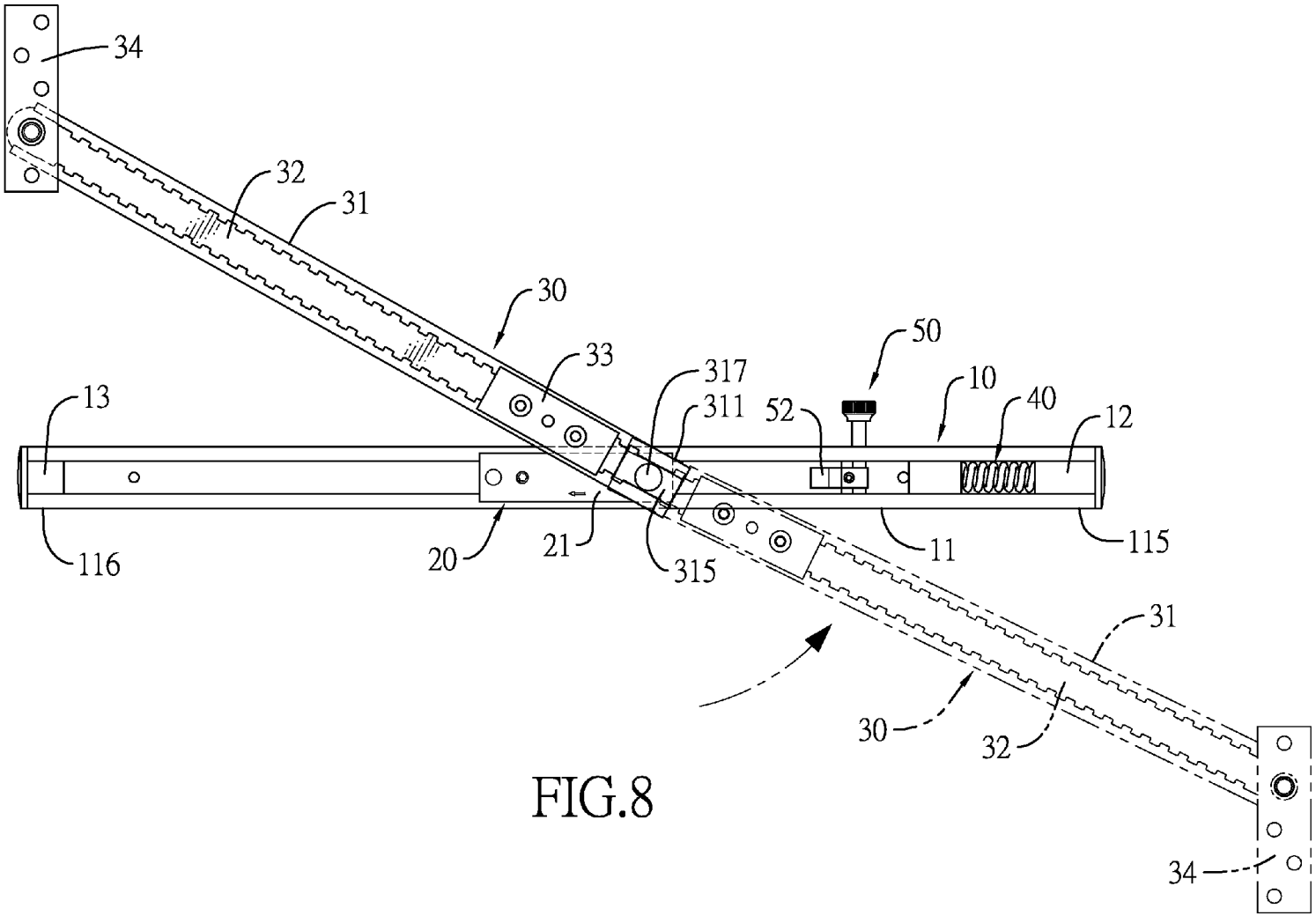
FIG. 8 is another operational top view of a door closer in FIG. 1.
Figure 9:
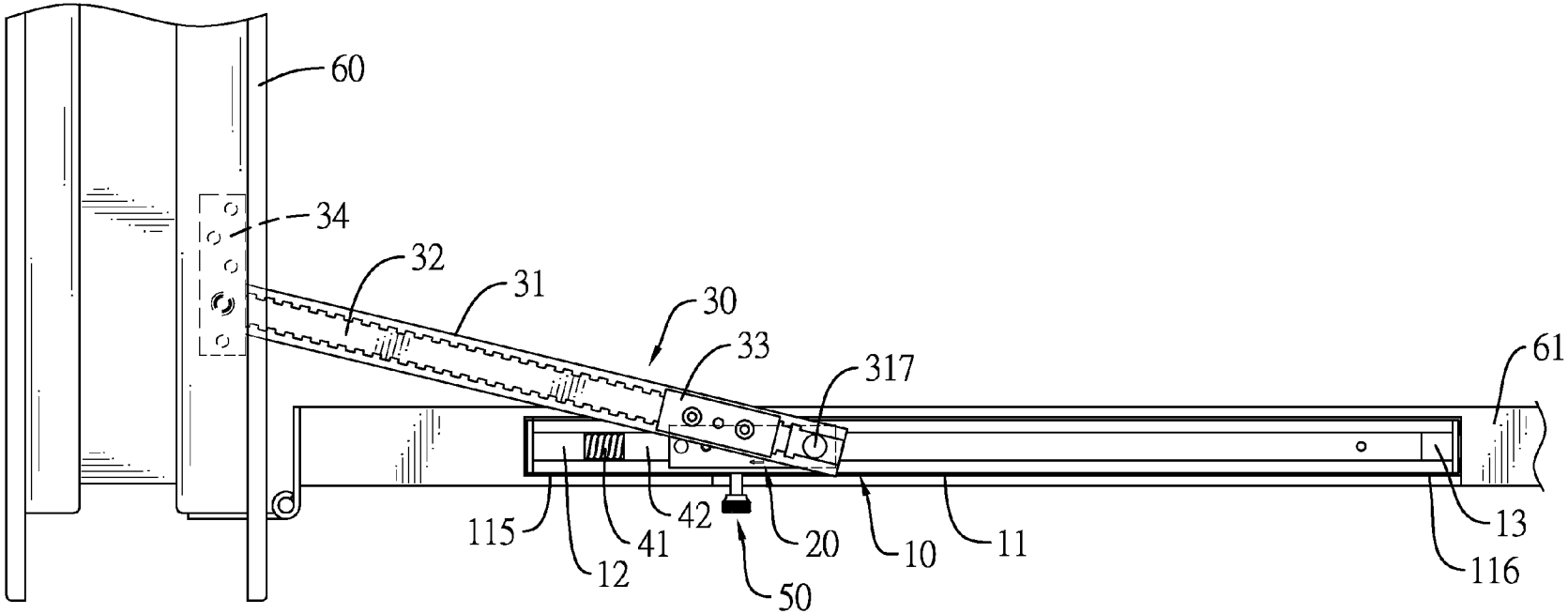
FIG. 9 is a further operational top view of a door closer in FIG. 1.

In assemble, with reference to FIGS. 8 and 9, when assembling the door closer in accordance with the present invention between a door frame 60 and a door panel 61, the total length of the extending set 30 can be adjusted by the engagement between the positioning teeth 314 of the guiding track 31 and the engaging teeth 332 of the locking board 33 and has a wider range of adjustment, and this can enable the door closer in accordance with the present invention to assemble between the door frame 60 and the door panel 61 of different sizes. Then, the cost of using the door closer in accordance with the present invention can be reduced and the practicality of the door closer can be promoted.

Figure 10:
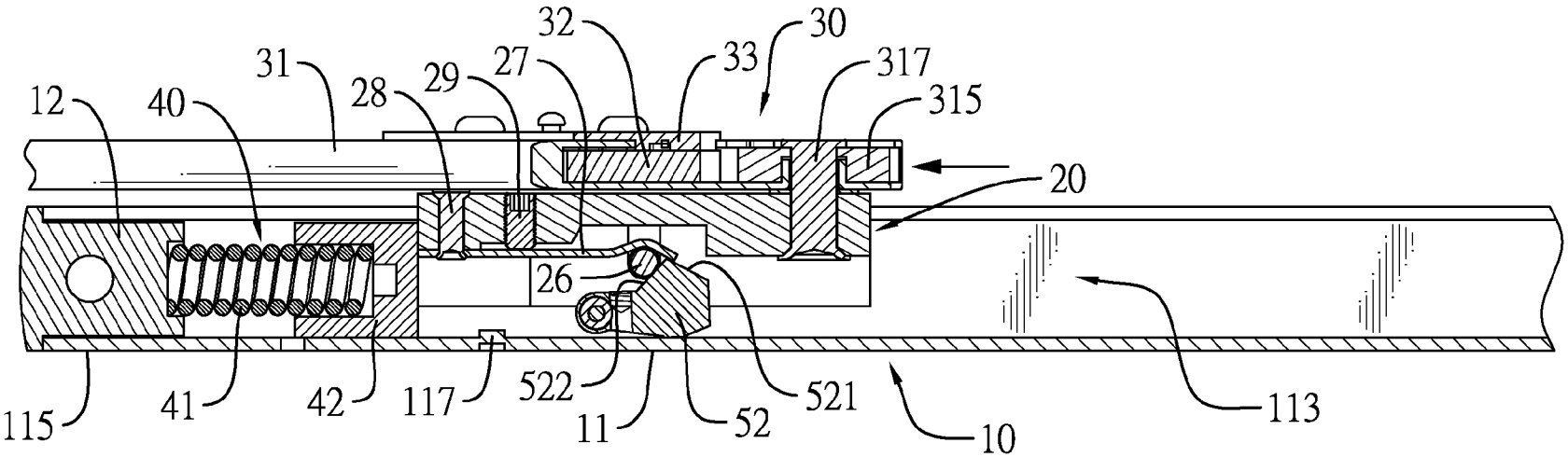
FIG. 10 is an enlarged operational side view in partial section of the door closer in FIG. 6.
Figure 11:
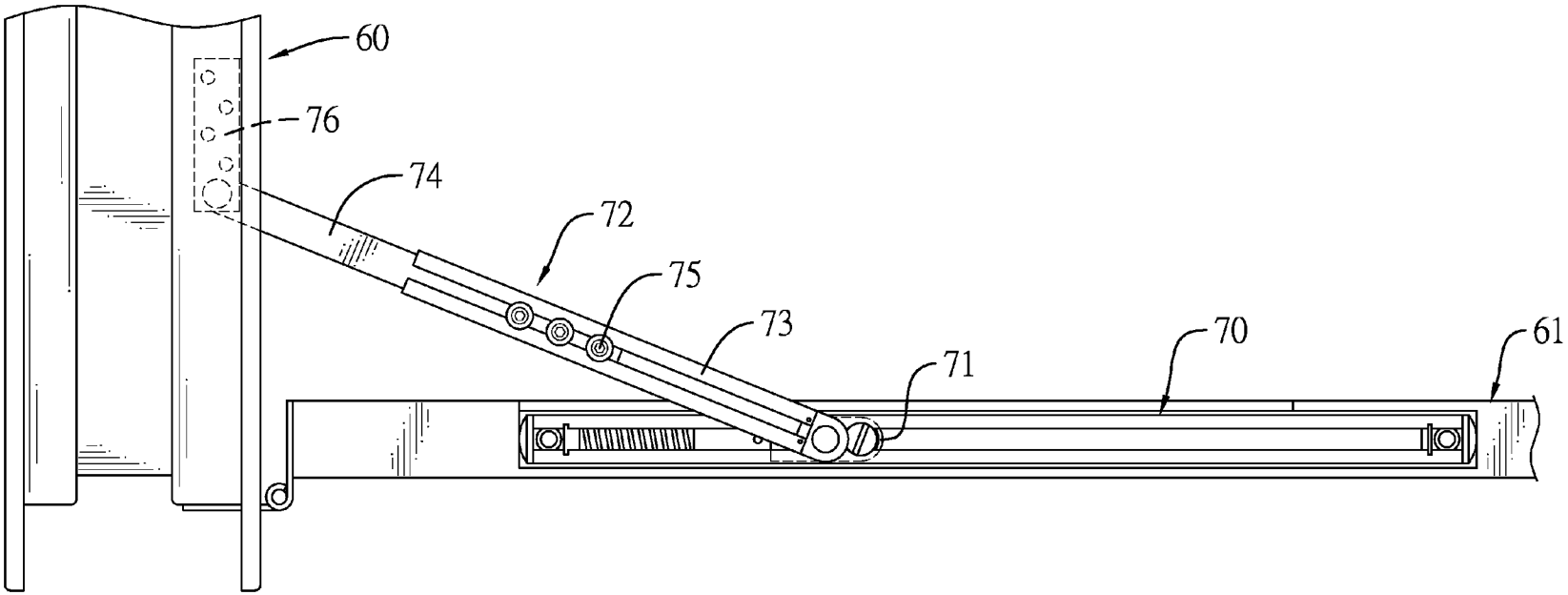
FIG.11 PRIOR ART
FIG. 11 is a top view of a door closer in accordance with the prior art connected to a door frame and a door panel.

After adjusting the total length of the extending set 30 to fit with the size of the door frame 60 and the door panel 61, the directional set 20 is mounted in the elongated tube 11 via the first end 115 of the elongated tube 11 or the second end 116 of the elongated tube 11 according to the size and the open direction of the door panel 61. The fixing set 10 is mounted in a recess of the door panel 61 that is formed in a top of the door panel 61 to enable the first end 115 of the elongated tube 11 to mount adjacent the hinges between the door frame 60 and the door panel 61 as shown in FIG. 10. After the above-mentioned assemble, the buffering set 40 can be mounted between the door frame 60 and the door panel 61 adjacent the hinges. In addition, the connecting panel 34 of the extending set 30 is securely connected to a bottom side of the door frame 60. In operation, when the door panel 61 is rotated relative to the door frame 60 to being in a closed condition or in an open condition, the extending set 30 can be rotated relative to the door frame 60 by the bidirectional set 20 moving in the elongated tube 11 of the fixing set 10.

With reference to FIGS. 9 and 10, during the door panel 61 is rotated relative to the door frame 60 to move at an intended open position, the bidirectional set 20 is moved by the extending set 30 toward the first end 115 of the elongated tube 11. When the bidirectional set 20 is moved across the switching set 50, the engaging rod 26 is pushed upwardly relative to the body 23 by abutting along the guiding face 521 of the switching mount 52. After the engaging rod 26 is moved across the guiding face 521 of the switching mount 52, the engaging rod 26 will be moved downwardly to abut along the holding face 522 of the switching mount 52 by a pressing force of the elastic slice 27. Then, the bidirectional set 20 can be positioned between the buffering block 42 and the switching mount 52, and this can held the door panel 61 stably at the intended open position. When the door panel 61 is rotated to move backwardly to the door frame 60, the engaging rod 26 will be moved with the bidirectional set 20 by the extending set 30 to across the switching mount 52, and the extending set 30 can provide an assist effect to the door panel 61 to move backwardly the original position relative to the door frame 60 in a closed condition.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A door closer comprising:

a fixing set having an elongated tube having a top;

a bottom;

a first end;

a second end being opposite to the first end of the elongate tube;

two opposite sidewalls formed on and protruding upwardly from the bottom of the elongated tube, facing to each other and each one of the opposite sidewalls having an upper track edge; and an opening formed through the top of the elongated tube between the upper track edges of the opposite sidewalls;

a bidirectional set connected to the fixing set, movably mounted in the elongated tube between the first end and the second end of the elongated tube and having a connecting board formed on and protruding from the bidirectional set, extending out of the opening of the elongated tube and having a top side and a bottom side; and an extending set pivotally connected to the bidirectional set and having a guiding track pivotally connected to the bidirectional set and having a bottom side abutting the top side of the connecting board;

a top side;

a pivot end mounted over the connecting board and the elongated tube;

an inserting end formed on the guiding track opposite to the pivot end of the guiding track;

a track opening formed through the top side of the guiding track to form two end edges at the top side of the guiding track;

multiple positioning teeth formed on and protruding inwardly from the end edges of the guiding track at intervals; and a pivot pin mounted through the bottom side of the guiding track and the connecting board of the bidirectional set and pivotally connected to the bidirectional set to enable the guiding track to rotate relative to the bidirectional set by the pivot end;

an extending arm movably mounted in the guiding track and having a connecting end extending out of the guiding track via the inserting end of the guiding track;

a locking board engaging the guiding track, connected to the extending arm to hold the locking board on the guiding track at the track opening of the guiding track to adjust a total length of the extending set and having an engaging segment abutting the extending arm, selectively engaging the guiding track and having a top side;

a bottom side abutting a top side of the extending arm;

two sidewalls; and multiple engaging teeth formed on and protruding from the sidewalls of the engaging segment at intervals and engaging the positioning teeth of the guiding track; and a compression spring mounted between the top side of the extending arm and the engaging segment of the locking board to form a gap between the extending arm and the locking board; and at least one screw mounted through the engaging segment of the locking board and securely connected to the extending arm to connect the locking board securely with the extending arm; and a connecting panel connected to the connecting end of the extending arm;

wherein when the at least one screw is loosened, the compression spring pushes the locking board to move upwardly relative to the guiding track to enable the engaging teeth to separate from the positioning teeth to enable the extending arm and the locking board to move relative to the guiding track to adjust a total length of the extending set.

2. The door closer as claimed in claim 1, wherein the locking board has a covering segment formed on the top side of the engaging segment, mounted over the positioning teeth of the guiding track to cover the track opening of the guiding track and having two opposite sides; and two pressing edges respectively formed on and protruding outwardly from the opposite sides of the covering segment and extending out of the engaging teeth of the engaging segment to press the positioning teeth of the guiding track.

3. The door closer as claimed in claim 2, wherein the extending arm has a positioning end mounted in the guiding track via the inserting end of the guiding track;

and a rivet mounted through the compression spring, the locking board and the extending arm and connected to a bottom side of the extending arm.

4. The door closer as claimed in claim 3, wherein
the fixing set has
a first end plug connected to the first end of the elongated tube; and
a second end plug connected to the second end of the elongated tube; and
the elongated tube has a track slot formed in the elongated tube between the bottom of the elongated tube and the opposite sidewalls of the elongated tube; and
the bidirectional set has
two sidewalls; and
two sliding recesses respectively formed in the sidewalls of the bidirectional set below the connecting board and respectively mounted on the upper track edges of the opposite sidewalls of the elongated tube to enable the bidirectional set to securely connect with the fixing set.

5. The door closer as claimed in claim 4, wherein
the bidirectional set has
a body formed on and protruding from the bottom side of the connecting board, movably mounted in the track slot of the elongated tube and having
a top side facing the upper track edges of the opposite sidewalls of the elongated tube;
a bottom side;
two sidewalls respectively facing the opposite sidewalls of the elongated tube;
two end sides respectively face the end plug and the second end plug of the fixing set; and
a concaved recess formed through the bottom side and the end sides of the body;
an engaging group mounted in the concaved recess of the body and having
an engaging rod mounted through the concaved recess of the body and movably connected to the sidewalls of the body;
an elastic slice mounted in the concaved recess of the body, pressed against the engaging rod and having
a pressing end pressed against the engaging rod;
a connecting end securely connected to the body by a fixing element mounted through the connecting board, mounted in the concaved recess of the body and connecting with the connecting end of the elastic slice;
a middle; and
a bolt mounted through the connecting board, mounted in the concaved recess of the body and pressed against the elastic slice at the middle of the elastic slice;
the sliding recesses are respectively formed in the sidewalls of the body near the top side of the body and below the connecting board;
the elongated tube has
a bottom board formed on the bottom of the elongated tube and having two opposite sides;
a limiting protrusion formed on and protruding from the bottom board adjacent to the first end of the elongated tube;
a buffering set mounted in the fixing set and having
a buffering block movably mounted in the track slot of the elongated tube at the first end of the elongated tube adjacent the first end plug and selectively abutting the limiting protrusion of the elongated tube; and
a buffering spring mounted in the track slot of the elongated tube between the first end plug and the buffering block to push the buffering block to abut against the limiting protrusion of the elongated tube; and
a switching set connected to the fixing set, selectively engaging the bidirectional set and having
a pivot pillar rotatably connected to the opposite sidewalls of the elongated tube adjacent to the first end of the elongated tube;
a switching mount securely mounted around the pivot pillar, rotatably mounted in the track slot of the elongated tube and selectively engaging the engaging rod of the engaging group of the bidirectional set and having
a mounting end securely mounted around the pivot pillar;
an engaging end being opposite to the mounting end of the switching mount;
a top;
a guiding face obliquely formed on the top of the switching mount at the engaging end of the switching mount and selectively abutting the engaging rod of the bidirectional set; and
a holding face obliquely formed on the top of the switching mount between the mounting end and the guiding face of the switching mount, selectively pressed against the engaging rod of the bidirectional set and having an angle relative to the guiding face; and
a rotating button securely connected to a free end of the pivot pillar at one of the opposite sidewalls of the elongated tube to rotate the switching mount relative to the elongated tube;
the opposite sidewalls of the elongated tube are respectively formed on and protrude upwardly from the opposite sides of the bottom board;
the track slot is formed in the elongated tube between the bottom board and the opposite sidewalls of the elongated tube and communicates with the opening of the elongated tube; and
the bidirectional set is movably mounted in the track slot of the elongated tube.

6. The door closer as claimed in claim 3, wherein
the guiding track has
a sealing block mounted in the guiding track at the pivot end of the guiding track; and
a first washer mounted between the top side of the connecting board and the bottom side of the guiding track;
the pivot pin of the guiding track is mounted through the sealing block, the bottom side of the guiding track, the first washer and the connecting board and is pivotally connected to the bidirectional set; and
the connecting panel has
a top side;
a bottom side;
a pivot rod mounted through the connecting end of the extending arm from the bottom side of the extending arm to the top side of the extending arm and connected to the connecting panel; and
at least one second washer mounted around the pivot rod between the connecting panel and the top side of the extending arm.

7. The door closer as claimed in claim 2, wherein
the fixing set has
a first end plug connected to the first end of the elongated tube; and a second end plug connected to the second end of the elongated tube; and the enlarged elongated tube has a track slot formed in the elongated tube between the bottom of the elongated tube and the opposite sidewalls of the elongated tube; and the bidirectional set has two sidewalls; and two sliding recesses respectively formed in the sidewalls of the bidirectional set below the connecting board and respectively mounted on the upper track edges of the opposite sidewalls of the elongated tube to enable the bidirectional set to securely connect with the fixing set.

8. The door closer as claimed in claim 5, wherein the bidirectional set has a body formed on and protruding from the bottom side of the connecting board, movably mounted in the track slot of the elongated tube and having a top side facing the upper track edges of the opposite sidewalls of the elongated tube;

a bottom side;

two sidewalls respectively facing the opposite sidewalls of the elongated tube;

two end sides respectively face the first end plug and the second end plug of the fixing set; and a concaved recess formed through the bottom side and the end sides of the body;

an engaging group mounted in the concaved recess of the body and having an engaging rod mounted through the concaved recess of the body and movably connected to the sidewalls of the body;

an elastic slice mounted in the concaved recess of the body, pressed against the engaging rod and having a pressing end pressed against the engaging rod;

a connecting end securely connected to the body by a fixing element mounted through the connecting board, mounted in the concaved recess of the body and connecting with the connecting end of the elastic slice;

a middle; and a bolt mounted through the connecting board, mounted in the concaved recess of the body and pressed against the elastic slice at the middle of the elastic slice;

the sliding recesses are respectively formed in the sidewalls of the body near the top side of the body and below the connecting board;

the elongated tube has a bottom board formed on the bottom of the elongated tube and having two opposite sides;

a limiting protrusion formed on and protruding from the bottom board adjacent to the first end of the elongated tube;

a buffering set mounted in the fixing set and having a buffering block movably mounted in the track slot of the elongated tube at the first end of the elongated tube adjacent the first end plug and selectively abutting the limiting protrusion of the elongated tube; and a buffering spring mounted in the track slot of the elongated tube between the first end plug and the buffering block to push the buffering block to abut against the limiting protrusion of the elongated tube; and a switching set connected to the fixing set, selectively engaging the bidirectional set and having a pivot pillar rotatably connected to the opposite sidewalls of the elongated tube adjacent to the first end of the elongated tube;

a switching mount securely mounted around the pivot pillar, rotatably mounted in the track slot of the elongated tube and selectively engaging the engaging rod of the engaging group of the bidirectional set and having a mounting end securely mounted around the pivot pillar;

an engaging end being opposite to the mounting end of the switching mount;

a top;

a guiding face obliquely formed on the top of the switching mount at the engaging end of the switching mount and selectively abutting the engaging rod of the bidirectional set; and a holding face obliquely formed on the top of the switching mount between the mounting end and the guiding face of the switching mount, selectively pressed against the engaging rod of the bidirectional set and having an angle relative to the guiding face; and a rotating button securely connected to a free end of the pivot pillar at one of the opposite sidewalls of the elongated tube to rotate the switching mount relative to the elongated tube;

the opposite sidewalls of the elongated tube are respectively formed on and protrude upwardly from the opposite sides of the bottom board;

the track slot is formed in the elongated tube between the bottom board and the opposite sidewalls of the elongated tube and communicates with the opening of the elongated tube; and the bidirectional set is movably mounted in the track slot of the elongated tube.

9. The door closer as claimed in claim 7, wherein the guiding track has a sealing block mounted in the guiding track at the pivot end of the guiding track; and a first washer mounted between the top side of the connecting board and the bottom side of the guiding track;

the pivot pin of the guiding track is mounted through the sealing block, the bottom side of the guiding track, the first washer and the connecting board and is pivotally connected to the bidirectional set; and the connecting panel has a top side;

a bottom side;

a pivot rod mounted through the connecting end of the extending arm from the bottom side of the extending arm to the top side of the extending arm and connected to the connecting panel; and at least one second washer mounted around the pivot rod between the connecting panel and the top side of the extending arm.

10. The door closer as claimed in claim 2, wherein the guiding track has a sealing block mounted in the guiding track at the pivot end of the guiding track; and a first washer mounted between the top side of the connecting board and the bottom side of the guiding track;

the pivot pin of the guiding track is mounted through the sealing block, the bottom side of the guiding track, the first washer and the connecting board and is pivotally connected to the bidirectional set; and the connecting panel has a top side;

a bottom side;

a pivot rod mounted through the connecting end of the extending arm from the bottom side of the extending arm to the top side of the extending arm and connected to the connecting panel; and at least one second washer mounted around the pivot rod between the connecting panel and the top side of the extending arm.

11. The door closer as claimed in claim 1, wherein the fixing set has a first end plug connected to the first end of the elongated tube; and a second end plug connected to the second end of the elongated tube; and the elongated tube has a track slot formed in the elongated tube between the bottom of the elongated tube and the opposite sidewalls of the elongated tube; and the bidirectional set has two sidewalls; and two sliding recesses respectively formed in the sidewalls of the bidirectional set below the connecting board and respectively mounted on the upper track edges of the opposite sidewalls of the elongated tube to enable the bidirectional set to securely connect with the fixing set.

12. The door closer as claimed in claim 11, wherein the bidirectional set has a body formed on and protruding from the bottom side of the connecting board, movably mounted in the track slot of the elongated tube and having a top side facing the upper track edges of the opposite sidewalls of the elongated tube;

a bottom side;

two sidewalls respectively facing the opposite sidewalls of the elongated tube;

two end sides respectively face the first end plug and the second end plug of the fixing set; and a concaved recess formed through the bottom side and the end sides of the body;

an engaging group mounted in the concaved recess of the body and having an engaging rod mounted through the concaved recess of the body and movably connected to the sidewalls of the body;

an elastic slice mounted in the concaved recess of the body, pressed against the engaging rod and having a pressing end pressed against the engaging rod;

a connecting end securely connected to the body by a fixing element mounted through the connecting board, mounted in the concaved recess of the body and connecting with the connecting end of the elastic slice;

a middle; and a bolt mounted through the connecting board, mounted in the concaved recess of the body and pressed against the elastic slice at the middle of the elastic slice;

the sliding recesses are respectively formed in the sidewalls of the body near the top side of the body and below the connecting board;

the elongated tube has a bottom board formed on the bottom of the elongated tube and having two opposite sides;

a limiting protrusion formed on and protruding from the bottom board adjacent to the first end of the elongated tube;

a buffering set mounted in the fixing set and having a buffering block movably mounted in the track slot of the elongated tube at the first end of the elongated tube adjacent the first end plug and selectively abutting the limiting protrusion of the elongated tube; and a buffering spring mounted in the track slot of the elongated tube between the first end plug and the buffering block to push the buffering block to abut against the limiting protrusion of the elongated tube; and a switching set connected to the fixing set, selectively engaging the bidirectional set and having a pivot pillar rotatably connected to the opposite sidewalls of the elongated tube adjacent to the first end of the elongated tube;

a switching mount securely mounted around the pivot pillar, rotatably mounted in the track slot of the elongated tube and selectively engaging the engaging rod of the engaging group of the bidirectional set and having a mounting end securely mounted around the pivot pillar;

an engaging end being opposite to the mounting end of the switching mount;

a top;

a guiding face obliquely formed on the top of the switching mount at the engaging end of the switching mount and selectively abutting the engaging rod of the bidirectional set; and a holding face obliquely formed on the top of the switching mount between the mounting end and the guiding face of the switching mount, selectively pressed against the engaging rod of the bidirectional set and having an angle relative to the guiding face; and a rotating button securely connected to a free end of the pivot pillar at one of the opposite sidewalls of the elongated tube to rotate the switching mount relative to the elongated tube;

the opposite sidewalls of the elongated tube are respectively formed on and protrude upwardly from the opposite sides of the bottom board;

the track slot is formed in the elongated tube between the bottom board and the opposite sidewalls of the elongated tube and communicates with the opening of the elongated tube; and the bidirectional set is movably mounted in the track slot of the elongated tube.

13. The door closer as claimed in claim 11, wherein the guiding track has a sealing block mounted in the guiding track at the pivot end of the guiding track; and a first washer mounted between the top side of the connecting board and the bottom side of the guiding track;

the pivot pin of the guiding track is mounted through the sealing block, the bottom side of the guiding track, the first washer and the connecting board and is pivotally connected to the bidirectional set; and the connecting panel has a top side;

a bottom side;

a pivot rod mounted through the connecting end of the extending arm from the bottom side of the extending arm to the top side of the extending arm and connected to the connecting panel; and at least one second washer mounted around the pivot rod between the connecting panel and the top side of the extending arm.

14. The door closer as claimed in claim 1, wherein the guiding track has a sealing block mounted in the guiding track at the pivot end of the guiding track; and a first washer mounted between the top side of the connecting board and the bottom side of the guiding track;

the pivot pin of the guiding track is mounted through the sealing block, the bottom side of the guiding track, the first washer and the connecting board and is pivotally connected to the bidirectional set; and the connecting panel has a top side;

a bottom side;

a pivot rod mounted through the connecting end of the extending arm from the bottom side of the extending arm to the top side of the extending arm and connected to the connecting panel; and at least one second washer mounted around the pivot rod between the connecting panel and the top side of the extending arm.

* * * * *